United States Patent [19]

Owen

[11] Patent Number: 4,731,953

[45] Date of Patent: Mar. 22, 1988

[54] KNIFE SHARPENER

[76] Inventor: Joe L. Owen, Rte. 1, Box 428, Roland, Okla. 74956

[21] Appl. No.: 825,984

[22] Filed: Feb. 4, 1986

[51] Int. Cl.[4] ..... B24B 3/54

[52] U.S. Cl. ..... 51/69; 51/221 BS; 51/58; 51/205 R; 76/82; 76/82.2; 76/88; 269/3

[58] Field of Search ..... 51/58, 221 BS, 221 R, 51/217 A, 217 R, 217 P, 69, 56, 205 WG, 205 R, 214, 60, 68, 69; 269/3; 76/82, 82.2, 88

[56] References Cited

U.S. PATENT DOCUMENTS

| | | | |
|---|---|---|---|
| 272,345 | 2/1883 | Stephens | 51/60 |
| 961,010 | 6/1910 | Poitras et al. | 76/82.2 |
| 2,504,423 | 4/1950 | Johnson et al. | 76/82.2 |
| 2,557,093 | 6/1951 | Garbarino | 51/69 |
| 4,216,627 | 8/1980 | Westrom | 51/69 |
| 4,471,951 | 9/1984 | LeVine | 269/3 |

*Primary Examiner*—Frederick R. Schmidt

*Assistant Examiner*—Robert A. Rose

*Attorney, Agent, or Firm*—Fleit, Jacobson, Cohn & Price

[57] ABSTRACT

A knife sharpener comprises an elongated blade holder with a clamping device for holding a blade at one end of the holder with the blade extending transversely the length of the holder, a post extending from the other end of the holder perpendicular to the plane in which the blade is gripped, and an elongated sharpening element having a sharpening surface extending over part of its length and a guide slot for receiving a ball at the top of the post extending along the remainder of its length. Engagement between the ball and the guide slot with the sharpening surface contacting an edge of the blade to be sharpened establishes the sharpening angle which is maintained throughout sharpening strokes of the sharpening element. The post may be adjustable in height to adjust the sharpening angle and may be replicated on opposite sides of the holder.

9 Claims, 5 Drawing Figures

FIG. 1
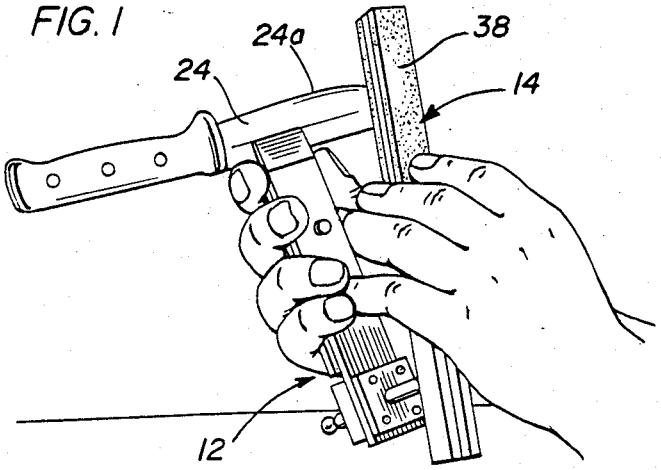
FIG. 2
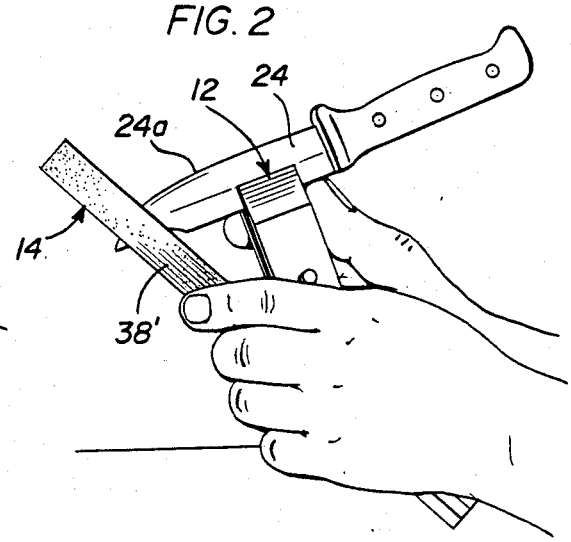
FIG. 3
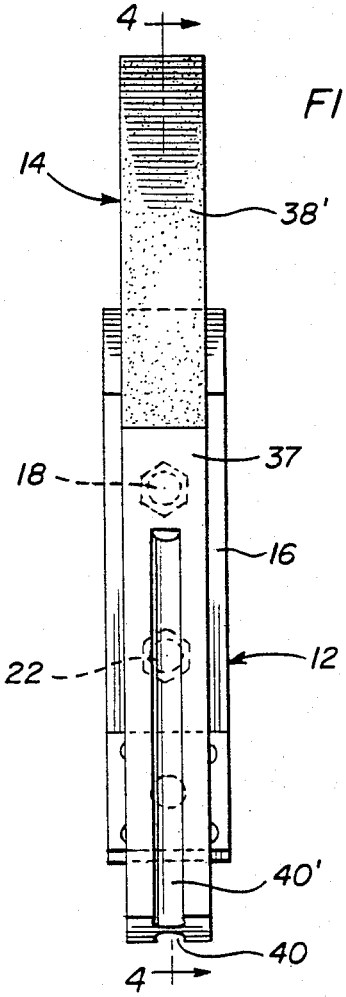
FIG. 4
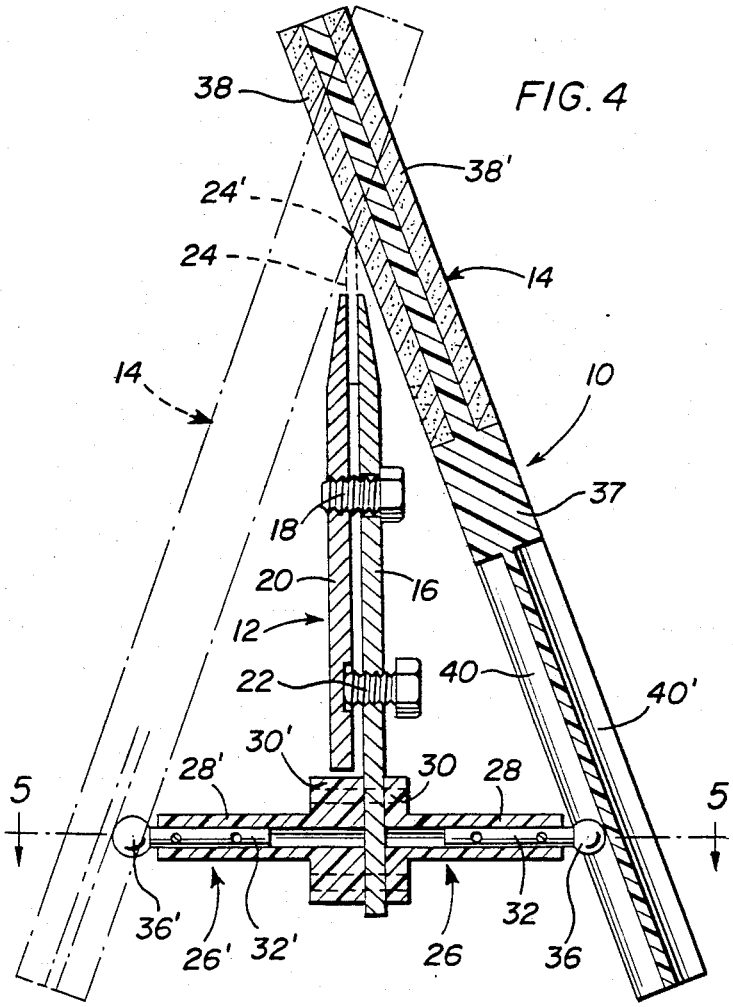
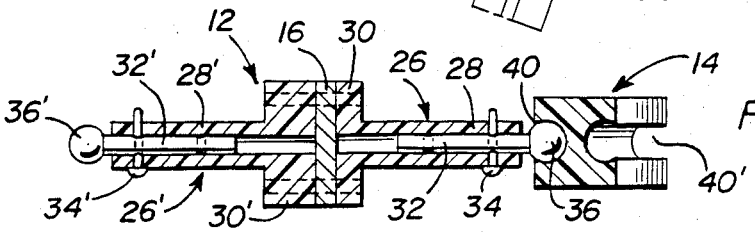
FIG. 5

KNIFE SHARPENER

BACKGROUND OF THE INVENTION

Field of the Invention

This invention relates to a portable knife sharpener.

Commonly, knives and other blades are sharpened manually while held in one hand, using a sharpening element such as a stone or rod held freely in the other hand. This procedure is somewhat inefficient in so far as it is not generally possible, for example, accurately to maintain a consistent sharpening angle along the length of a blade. The invention provides a jig-type sharpening device which can be used in a simple manner to provide more effective manual sharpening of knife blades and the like.

SUMMARY OF THE INVENTION

A knife sharpener in accordance with the invention comprises an elongated blade holder and an elongated sharpener element. The blade holder is formed with a clamping device at one end for gripping a knife or other blade with the blade extending transversely with respect to the holder, and an upright post adjacent the other end having a ball at its free end, the post extending perpendicularly to a plane in which the blade is gripped. The sharpener element has an elongated abrasive sharpener insert along a part of its length and a shaped groove along the remainder of its length for captively receiving the ball, with the sharpener element engaging an edge of the blade to be sharpened in a manner whereby the sharpening element can be reciprocated lengthwise relative to the ball and also arcuately for sharpening said edge.

It will be understood that the height of the post above the blade determines the angle of the sharpening insert where it contacts the blade, hence the angle at which the blade is sharpened, and this angle remains constant throughout the reciprocatory movements of the sharpener element. Further, the post may be telescopically adjusted so that the angle can be varied to suit different blade requirements.

The post may be replicated on each side of the holder so that the sharpener element can be used on the two posts sequentially to sharpen opposite sides of a blade. The sharpener insert and groove may also be replicated top and bottom of the sharpener element. The device is simple to set up and use, and effective in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWINGS

FIG. 1 is an in-use perspective view of a knife sharpener in accordance with the invention shown in one working configuration.

FIG. 2 is a view similar to FIG. 1 in a reverse working configuration.

FIG. 3 is an enlarged plan view of the knife sharpener.

FIG. 4 is a sectional view on line 4—4 of FIG. 3.

FIG. 5 is a sectional view on line 5—5 of FIG. 4.

DESCRIPTION OF PREFERRED EMBODIMENTS

A knife sharpener 10 in accordance with the invention comprises an elongated blade holder 12 and an elongated sharpening element 14. The holder 12 includes a main plate 16 connected by a clamp screw 18 near a forward end thereof to a conforming gripping plate 20, with a set screw 22 behind screw 18 threaded through plate 16 against plate 20 so as to form a clamp at one end of the holder for a knife or like blade 24. Thus, blade 24 can be releasably clamped in the holder in a position extending transversely across one end of the holder by first tightening screw 18 and then screw 22.

Toward the back end of plate 16 are a pair of oppositely extending post assemblies 26, 26'. Post 26 comprises a tubular sleeve 28 on a base 30 and a stud 32 telescopically received in sleeve 28. The stud and sleeve have spaced transverse holes and a locking pin 34 enabling the height of the post to be adjusted. The stud 32 has a ball 36 on its outer end. Post 26' has a similar base 30', sleeve 28', stud 32', and ball 36'.

The sharpening element 14 comprises a rod 37 recessed at its front end to receive opposed elongated abrasive stone or like sharpener inserts 38, 38'. At its back end, the rod is formed with opposed longitudinally extending part-circular sections guideway grooves 40, 40' shaped to receive the balls 36, 36' of post assemblies 26, 26' when inserted from a free end of the respective groove. Each groove has a cross sectional extent which is somewhat in excess of a 180 degrees, so that the balls can only be inserted and removed at the end of the groove but when engaged on a ball the sharpening element can be moved back and forth, swiveled arcuately side to side, and rocked to an extent about its longitudinal axis.

Reference to FIG. 4 will make it readily apparent that the particular height at which the respective post assembly 26 or 26' is set, establishes the angle of the sharpening element relative to blade 24 by contact of the element with edge **24*a* of the blade which is to be sharpened, thus establishing the sharpening angle. Furthermore, the sharpening angle is maintained (neglecting the effects of wear) throughout sharpening strokes of the sharpening element, which may be back and forth, or side to side, with the possibility of a slight rocking movement of the sharpening element to accommodate the curve at the end of blade 24**.

The sharpening element can be used alternatively on posts 26 and 26' to sharpen opposite sides of the blade 24 as shown respectively in FIGS. 1 and 2, and the sharpening element can itself be reversed to use the respective sharpening inserts 38, 38'.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sharpening device comprising an elongated blade holder and an elongated sharpening element, the blade holder having a blade clamping means for gripping a blade to be sharpened at one end of the holder with the blade extending substantially transversely with respect to the holder, and a post extending from the other end of the holder perpendicular to the plane in which the blade is gripped, the post terminating in a head formation, the sharpening element including a longitudinal sharpening surface extending over part of its length and a longitudinal guide slot extending over another part of its length for receipt of the head formation therein in a manner enabling the sharpening surface to be longitudinally and arcuately reciprocated across an edge of the blade to be sharpened while maintaining a preset angle, determined by the height of the post, between the sharpening surface and the blade, said head formation being a ball on the end of the post and the guide slot being of part-circular cross section for receipt of the ball.

2. The invention as defined in claim 1 wherein the guide slot extends to one end of the sharpening element and has a cross section with an arc in excess of 180 degrees.

3. The invention as defined in claim 1 wherein the post has telescopic sections for adjusting the height of the post.

4. The invention as defined in claim 1 wherein the post, sharpening surface and guide slot are replicated on opposite sides of the holder.

5. The invention as defined in claim 1 wherein the sharpening surface is a surface of a sharpening insert secured on the holder.

6. The invention as defined in claim 1 wherein the holder comprises a main plate and the clamping means comprises a clamping plate secured to the main plate by a clamp screw extending through an aperture in the main plate and screw threaded into the clamping plate adjacent ends of the plates which engage the blade to be sharpened and a set screw threaded through one of the plates and engaging the other plate at a point remote from the ends of the plates which engage the blade to be sharpened for secure clamping engagement of the blade.

7. A blade sharpener comprising a blade holder and a sharpening element for engaging the sharpenable edge of a blade supported by said blade holder at a predetermined angle which is maintained during longitudinal reciprocation of the sharpening element in relation to the sharpenable edge of the blade, said blade holder having a pair of clamping jaws engaged with a small lengthwise portion of the edge of the blade remote from the sharpenable edge and extending perpendicular from the blade, a post rigid with one of the clamping jaws and extending in perpendicular relation to the jaws and perpendicular to a plane in which the blade is positioned, said sharpening element including an elongated straight sharpening surface engaging the sharpenable edge of the blade, said post and sharpening element including coacting means enabling longitudinal reciprocation of the sharpening surface while in contact with the sharpenable edge of the blade while maintaining the sharpening surface at a predetermined angle in relation to the plane of the blade, said coacting means including a head formation on the outer end of the post and longitudinal groove means along the inner surface of the sharpening element, said groove means slidingly receiving said head formation and being disposed inwardly of the side edges of the sharpening element to facilitate gripping of the area of the sharpening element where it slidingly engages the head formation whereby both hands of a user of the sharpener may be disposed laterally outwardly of the non-sharpenable edge of the blade.

8. A blade sharpener comprising a blade holder and a sharpening element for engaging the sharpenable edge of a blade supported by said blade holder at a predetermined angle which is maintained during longitudinal reciprocation of the sharpening element in relation to the sharpenable edge of the blade, said blade holder having a pair of clamping jaws engaged with a small lengthwise portion of the edge of the blade remote from the sharpenable edge and extending perpendicular from the blade, a post rigid with one of the clamping jaws and extending in perpendicular relation to the jaws and perpendicular to a plane in which the blade is positioned, said sharpening element including an elongated straight sharpening surface engaging the sharpenable edge of the blade, said post and sharpening element including coacting means enabling longitudinal reciprocation of the sharpening surface while in contact with the sharpenable edge of the blade while maintaining the sharpening surface at a predetermined angle in relation to the plane of the blade, said coacting means including a ball on the outer end of the post and a longitudinal groove in said sharpening element slidably receiving said ball, said groove being in axial alignment with the elongated sharpening surface to maintain the sharpening surface at the same angle in relation to the plane of the blade during longitudinal reciprocation of the sharpening surface, said sharpening element including an elongated body of unitary construction with the groove engaging more than one-half of the periphery of the ball, said groove being provided with an open end remote from the sharpening surface to enable assembly and disassembly of the sharpening element and blade holder without manipulation of fastening devices.

9. The blade sharpener of claim 8 wherein said sharpening element has a sharpening surface and groove extending longitudinally along opposite surfaces of said body, said blade holder including identical posts projecting from opposite sides thereof with both posts being integral with the same clamp jaw.

* * * * *